US005607281A

United States Patent [19]

Egolf et al.

[11] Patent Number: 5,607,281

[45] Date of Patent: Mar. 4, 1997

[54] TRANSFER DEVICE IN A PRESS

[75] Inventors: Theo Egolf, Bösingen; Urs Flühmann, Wabern, both of Switzerland

[73] Assignee: Styner & Bienz AG, Niederwangen, Switzerland

[21] Appl. No.: 507,736

[22] Filed: Jul. 26, 1995

[30] Foreign Application Priority Data

Jul. 29, 1994 [CH] Switzerland ..... 02405/94

[51] Int. Cl.[6] ..... B65G 25/04

[52] U.S. Cl. ..... 414/751; 72/405.11; 198/468.5; 198/621.1; 294/65.5

[58] Field of Search ..... 414/749, 751, 414/737, 606; 198/468.2, 468.5, 468.9, 621.1; 72/405, 419; 901/39, 40; 294/902, 2, 65.5, 119.1

[56] References Cited

U.S. PATENT DOCUMENTS 3,040,921 6/1962 Davis ..... 294/65.5

3,151,735 10/1964 DeGain .

3,754,667 8/1973 Storch ..... 198/621.1

FOREIGN PATENT DOCUMENTS 3425066 1/1985 Germany .

*Primary Examiner*—Donald W. Underwood

*Attorney, Agent, or Firm*—Richard Linn

[57] ABSTRACT

The grippers (2, 3), which are mounted on the transport bars (1), are provided with permanent magnets (6). In order to seize and transfer a workpiece (4), the two grippers are moved toward the workpiece from the outside, while the front surfaces (5) of the grippers position the workpiece and the magnets (6) lift up the workpiece by some distance. It is thus ensured in a very simple manner that the workpiece may safely enter the following processing station of a follow-on tool.

12 Claims, 1 Drawing Sheet

TRANSFER DEVICE IN A PRESS

BACKGROUND OF THE INVENTION

The present invention refers to a transfer device in a press, for the stepwise transport of workpieces through processing stations of a tool, comprising transport bars which are disposed laterally with respect to the tool and which are provided with grippers for gripping workpieces and are capable of being reciprocated in the longitudinal and the transversal directions in a cyclic movement. In each working cycle, said transport bars perform a closed rectangular movement by advancing a number of seized workpieces to the following station of the tool in a first step, then being laterally retired from said tool, longitudinally returned, and moved towards said tool again in order to seize the workpieces. In the process, considerable accelerations and decelerations and correspondingly high forces of inertia result, so that the working cadence of said press is limited by the rigidity and the stability of said transfer device. Relatively narrow limits are thus set since any increase of the rigidity and of the mechanical deformation stability of the transport bars leads to an increase of weight which in turn results in an increase of the forces of inertia.

In order to ensure a disturbance-free transfer of the workpieces, an additional vertical movement is superimposed on the above-mentioned horizontal transfer movement, the transport bars and the grippers being lifted up a small distance each time after having seized the workpieces in order to allow a safe entry of the seized workpieces into the following station of the tool. Without this vertical movement, there is a risk that workpieces might collide with parts of the following station when entering the same. This additional vertical movement of the transport bars involves considerable costs as well as an increase of the inert mass.

SUMMARY OF THE INVENTION

It is the object of the present invention to considerably simplify the transfer device. This object is attained by a transfer device wherein at least a part of the grippers are provided with lifting magnets in order to lift the workpiece during its transport from one processing station to the following one by magnetic attraction. By utilizing this very simple measure, the disadvantageous vertical movement of the transport bars and of the grippers is no longer necessary. Another advantage is that the grippers can be designed as rigid grippers and can be rigidly connected to the transport bars. They need only be provided with positioning means, e.g. V-shaped front surfaces or positioning pins, which maintain the workpieces in the desired position when they are lifted up by the magnets and transferred from one processing station to the following one.

BRIEF DESCRIPTION OF THE DRAWINGS

The invention is now explained in more detail with reference to an embodiment which is represented in the attached drawings.

DETAILED DESCRIPTION OF THE INVENTION

Figure 1:
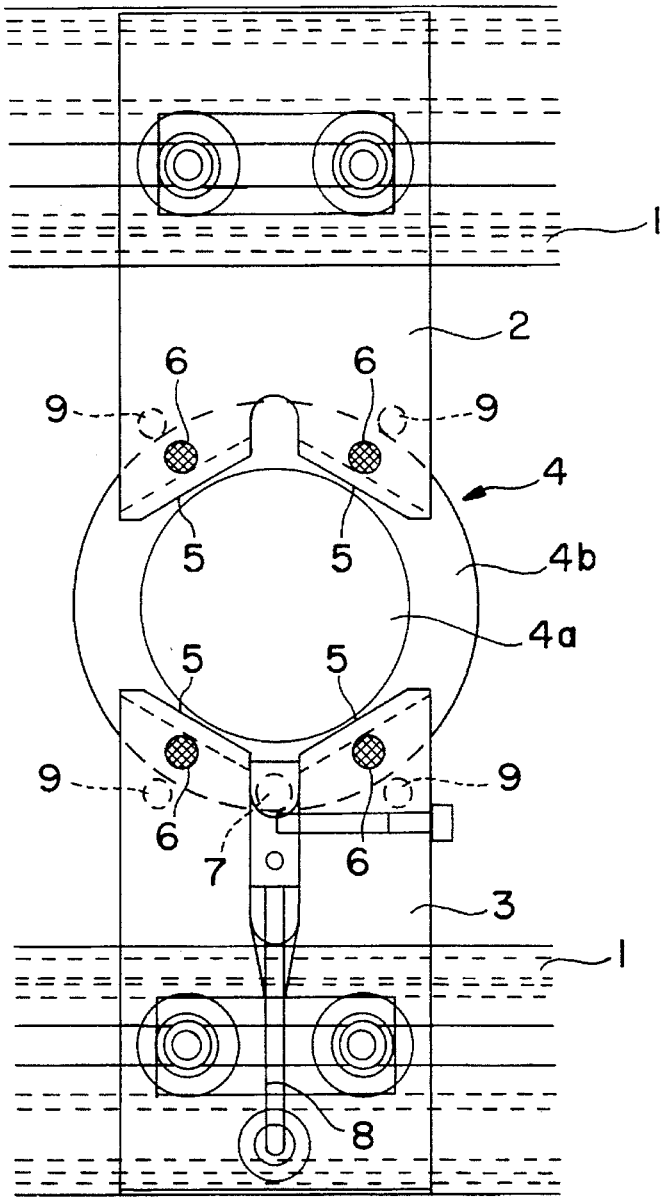
FIG. 1 shows a plan view of a gripper pair and a workpiece.

FIG. 1 shows a section of the transfer system of a press, including two transport bars 1 on which two rigid grippers 2 and 3 are solidly mounted. As described in the introduction, said grippers serve the purpose of seizing and transporting a workpiece 4, namely a deep-drawn part having a raised center portion 4*a* and an annular flange 4*b*. The two grippers 2 and 3 have V-shaped front surfaces 5 which in the closed position as represented in FIG. 1, wherein the two grippers 2 and 3 are at their smallest mutual distance, rest on the raised center portion 4*a* of workpiece 4 with some play and maintain the latter in a certain position. The two grippers are each provided with two permanent magnets 6 whose lower front surfaces are even with the undersides of grippers 2 and 3. In a slot of gripper 3, a sensor 7 for presence detection is mounted which is connected to the press control unit by a cable 8.

Figure 2:
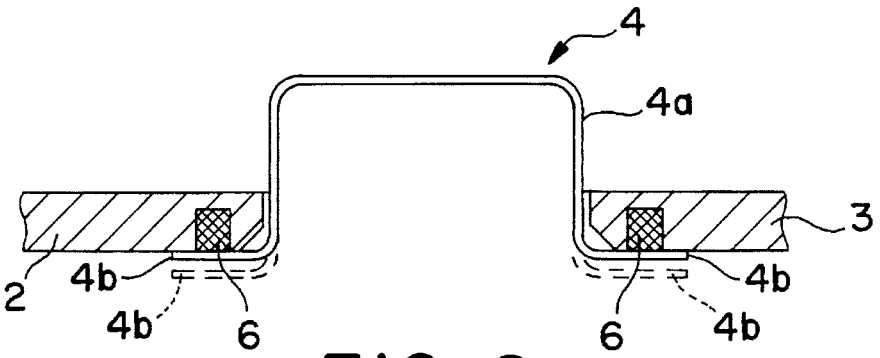
FIG. 2 shows a partial cross-section of the gripper pair and the workpiece.

It is assumed that after its treatment in a processing station, a workpiece is in the position indicated in FIG. 2 by dotted lines. In order to seize and advance the workpiece, transport bars 1 with grippers 2 and 3 are moved from a spreaded position to the closed or approached position as shown in FIG. 1 and 2. In the process, the grippers move inwards above the flange 4*b* of the workpiece, as shown in FIG. 2, and their front surfaces 5 position the workpiece in such a manner as to prevent its lateral displacement. However, said positioning is effected with a certain amount of play, i.e. the workpiece is allowed to move substantially freely between the grippers in the vertical direction. Magnets 6, which are now positioned above flange 4*b*, subsequently lift the ferromagnetic workpiece up to the raised position as shown in FIG. 2 by solid lines and in which the workpiece is transferred to the following processing station. Meanwhile, sensor 7 monitors the presence of a workpiece and effects an immediate stop of the press in the case of its absence.

The represented embodiment demonstrates a manner of positioning and lifting deep-drawn workpieces. Flatter workpieces cannot be positioned in this manner. In this case, grippers 2 and 3 may be provided with positioning pins which either abut to the edge of the workpiece externally or else engage in positioning holes of the workpiece. Such positioning pins 9 which serve the purpose of positioning the workpiece by externally abutting to flange 4*b* are represented in FIG. 1 by dotted and dashed lines. However, positioning pins might be provided which engage in positioning holes of the workpiece when the latter is lifted up by magnets 6.

We claim:

1. Transfer device in a press, for the stepwise transport of workpieces through processing stations of a tool, comprising transport bars which are disposed laterally with respect to the tool and which are provided with grippers for workpieces and capable of being reciprocated in the longitudinal and the transversal directions in a cyclic movement, wherein at least a part of the grippers are provided with lifting magnets in order to lift the workpiece in a vertical movement during its transport from one processing station to the following one by magnetic attraction.

2. The device of claim 1, wherein the grippers are provided with positioning members which contribute to determining the position of the workpiece when it is being lifted up by the magnets and transferred.

3. The device of claim 2, wherein said positioning members are V-shaped positioning surfaces.

4. The device of claim 2, wherein said positioning members are positioning pins.

5. The device of claim 1, wherein at least one gripper of certain gripper pairs is provided with a presence detector, e.g. a proximity switch.

6. The device of claim 1, wherein said grippers are rigid grippers rigidly connected to the transport bars.

7. A transfer device in a press for the stepwise transport of workpieces through processing stations of a tool, comprising:

transport bars which are disposed laterally with respect to the tool and are capable of being reciprocated in longitudinal and transversal directions in a cyclic movement in a horizontal plane; and grippers provided on said transport bars for gripping workpieces;

wherein at least part of the grippers are provided with lifting magnets in order to lift the workpiece in a vertical direction by magnetic attraction during its transport from one processing station to a following processing station by magnetic attraction in order to lift the workpiece clear from a tool in a next station.

8. The device of claim 7, wherein the grippers are provided with positioning members which contribute to determining the position of the workpiece when it is being lifted up by the magnets and transferred.

9. The device of claim 8, wherein said positioning members are V-shaped positioning surfaces.

10. The device of claim 8, wherein said positioning members are positioning pins.

11. The device of claim 7, wherein at least one gripper of certain gripper pairs is provided with a presence detector, e.g. a proximity switch.

12. The device of claim 7, wherein said grippers are rigid grippers rigidly connected to the transport bars.

* * * * *